US006494360B1

(12) United States Patent
Flehmig et al.

(10) Patent No.: US 6,494,360 B1
(45) Date of Patent: Dec. 17, 2002

(54) METHOD AND DEVICE FOR PRODUCING STRAIGHT BEAD WELDED PIPES FROM FLAT SHEET METAL BLANKS

(75) Inventors: Thomas Flehmig, Ratingen (DE); Klaus Blümel, Dinslaken (DE); Thomas Neuhausmann, Moers (DE)

(73) Assignee: Thyssen Krupp Stahl AG, Dusseldorf (DE)

( * ) Notice: Subject to any disclaimer, the term of this patent is extended or adjusted under 35 U.S.C. 154(b) by 0 days.

(21) Appl. No.: 09/720,479

(22) PCT Filed: Jun. 23, 1999

(86) PCT No.: PCT/EP99/04338

§ 371 (c)(1),
(2), (4) Date: Dec. 22, 2000

(87) PCT Pub. No.: WO99/67037

PCT Pub. Date: Dec. 29, 1999

(30) Foreign Application Priority Data

Jun. 23, 1998 (DE) ..... 198 27 798

(51) Int. Cl.[7] ..... B21C 37/08; B21D 5/10; B23K 37/04

(52) U.S. Cl. ..... 228/173.6; 228/5.7; 228/17.5

(58) Field of Search ..... 228/17.5, 5.7, 228/141.1, 164, 173.1, 173.6; 219/61, 61.1, 61.11

(56) References Cited

U.S. PATENT DOCUMENTS

| | | | | | |
|---|---|---|---|---|---|
| 1,381,647 | A | * | 6/1921 | Knoll | 219/137.2 |
| 1,810,112 | A | * | 6/1931 | Riemenschneider | 219/61 |
| 1,899,143 | A | * | 2/1933 | Frahm et al. | 228/151 |
| 2,110,378 | A | | 3/1938 | Hume | 72/113 |
| 3,285,490 | A | * | 11/1966 | Roper | 228/17.5 |
| 3,732,614 | A | * | 5/1973 | Boutell | 228/150 |
| 3,751,623 | A | * | 8/1973 | Doublet | 219/67 |
| 3,846,610 | A | * | 11/1974 | Asselborn et al. | 219/61 |
| 4,207,453 | A | * | 6/1980 | Astill | 219/61.11 |
| 4,995,549 | A | * | 2/1991 | Hellman, Sr. | 228/147 |

FOREIGN PATENT DOCUMENTS

| | | | | |
|---|---|---|---|---|
| DE | 593 622 | | 3/1934 | |
| DE | 966 111 | * | 7/1957 | |
| DE | 44 32 674 C1 | | 2/1996 | |
| FR | 1 254 669 | * | 5/1961 | |
| FR | 2 144 049 | * | 2/1973 | B21C/37/00 |

* cited by examiner

*Primary Examiner*—M. Alexandra Elve
*Assistant Examiner*—Kevin P. Kerns
(74) *Attorney, Agent, or Firm*—Proskauer Rose LLP

(57) ABSTRACT

An apparatus to produce straight bead welded tubes from flat sheet metal blanks with two parallel longitudinal edges includes two form tool halves. The two form tool halves have outer cylindrical half shells borne by a tool support, and are disposed laterally inverted in relation to one another. They are moved towards one another and out of an opened receiving position for the sheet metal blanks into a closed position, in which the two longitudinal edges are held together by the two form tool halves. The apparatus also includes a welding device, which moves over the two form tool halves along the two longitudinal edges retained in a welding position. The two form tool halves have cylindrical internal mandrel halves which are fixedly associated with the outer cylindrical half shells and which cooperate with the outer cylindrical half shells to produce form gaps for insertion of the sheet metal blanks.

23 Claims, 7 Drawing Sheets

METHOD AND DEVICE FOR PRODUCING STRAIGHT BEAD WELDED PIPES FROM FLAT SHEET METAL BLANKS

BACKGROUND OF THE INVENTION

Various processes and apparatuses are known for the production of straight bead welded tubes from strips and sheet metal blanks, but none of them make possible the economic manufacture in medium size runs of tubes having a relatively short length (for example, 1=3000 mm), a small diameter (for-example, d=50 mm) and a relatively large wall thickness (for example, t=2.5 mm). It is therefore an object of the invention to provide a process and an apparatus for the production of such tubes.

In the prior art process of roller shaping (U.S. Pat. No. 2,110,378) a strip is shaped in a number of successively arranged stages by driven profiled rollers to give a slotted tube which is then welded. The investment cost of an installation suitable for this purpose is very high, so that it is unsuitable for the production of tubes in medium size runs.

In the prior art 3-roller bending, a flat sheet metal blank with two supporting rollers is bent around a working roller. Such a process enables tubes to be produced with a wall thickness of, for example, 1.0 mm and a diameter of 50 mm only with a length of less than 2000 mm, since the supporting rollers sag due to the heavy supporting forces to be applied. There is also the aspect that the resulting slotted tube must be removed from the apparatus and straight bead welded at another place.

A clamping and retaining apparatus for relatively short slotted tubes is also known (DE 44 32 674 C1) in which the slotted tube is retained by bands, which are partially looped around the tube, in a suitable welding position for a welding device which can be driven along the joint gap. To obtain a straight bead welded tube, therefore, a sheet metal blank must be shaped into a slotted tube in a separate apparatus.

In another prior art apparatus (DE-PS 966 111) for the production of straight bead welded tubes from flat sheet metal blanks with parallel longitudinal edges, the sheet metal blank is shaped into a slotted tube in the same apparatus, being retained by the means shaping the tube with the longitudinal edges to be welded in the welding position. Two form tools disposed laterally inverted in relation to one another, which are borne by a tool support, can be driven towards one another, and have outer cylindrical half shells received in their opened receiving position the sheet metal blank at its two longitudinal edges. When the form tool halves are moved together, the sheet metal blank is retained at its two ends fixed in the center, so that the sheet metal blank slides along the cylindrical half shells on both sides until its longitudinal edges impinge on one another at the top point. The sheet metal blank shaped into a slotted tube is retained in this position. Then, to weld the longitudinal edges to one another, the top ends of the form tool halves can be hinged upwards, so that the joint gap is opened up. An important disadvantage of such an apparatus is that there is the risk that the sheet metal blank may bend outwards for lack of internal and external guiding. This risk is particularly great in the case of thin-walled sheet metal blanks.

In a very similar prior art apparatus for the shaping of sheet metal blanks into tubes, which are then welded (DE-PS 593 622) the two form tool halves are formed not by cylindrical half shells, but by axially offset discs with cutaway portions in the shape of arcs of a circle. The apparatus is to be used to form a conical tube from a sheet metal blank. To this end the disc cutaway portions in the shape of arcs of a circle increase in radius in the axial direction. However, in distinction from the other afore-described prior art apparatus, in this prior art apparatus an internal conical mandrel is associated with the outer parts of the form tool halves. However, the mandrel is not operative during the entire shaping operation, but only at the end thereof, since it is applied to the sheet metal in the center between the form tool halves. Due to the absence of internal and external guiding during the shaping operation, even the use of such a mandrel does not obviate the risk that the sheet metal blank will bend outwards during the shaping operation.

BRIEF SUMMARY OF THE INVENTION

It is an object of the invention to provide a process and an apparatus which enable straight bead welded tubes to be produced from sheet metal blanks, more particularly blanks with a thin wall thickness. More particularly, the process and the apparatus are suitable for the processing of sheet metal blanks of different thicknesses, for example, so-called tailored blanks.

The invention therefore starts from a process for the production of a straight bead welded tube from a flat sheet metal blank having parallel longitudinal edges, wherein the sheet metal blank is shaped into a slotted tube by means of two form tool halves having outer cylindrical half shells and disposed laterally inverted in relation to one another which can be moved towards one another, whereafter the longitudinal edges are welded to one another at the top of the form tool, being retained in position by the form tool halves. In such a process according to the invention during shaping the sheet metal blank is borne on the inside by internal cylindrical mandrel halves co-operating with the outer half shells to produce form gaps, the longitudinal edges emerging at the top retaining exposed for welding (sic).

The invention also relates to an apparatus for the production of straight bead welded tubes from flat sheet metal blanks with parallel longitudinal edges having: form tool halves having outer cylindrical half shells and disposed laterally inverted in relation to one another which are borne by a tool support and can be moved towards one another and can be moved out of an opened receiving position for the sheet metal blank into a closed position, in which the longitudinal edges to be welded to one another are held together by the closed tool halves at their top point, the device also having a welding device which can be moved over the form tool halves along the longitudinal edges retained in the welding position. In such an apparatus the invention is characterized in that the form tool halves have cylindrical internal mandrel halves which are associatedly fixed with the outer half shells and which cooperate with the outer half shells to produce form gaps for the sheet metal blank to be inserted, while in the closed position of the form tool halves the form gaps retain the longitudinal edges emerging therefrom at the top exposed for welding.

The process according to the invention and the apparatus according to the invention enable sheet metal blanks of different thicknesses to be formed into a cylindrical tube without any risk that the blank will bend outwards during the shaping operation. More particularly, the invention enables short tubes to be economically produced in medium size runs from sheet metal blanks. Both tubes having a constant wall thickness can be produced, and also tubes which have differential wall thickness over their length or periphery. The special advantage of the invention is that the form tool halves themselves retain the shaped slotted tube with the joint gap in an optimum welding position, to produce the weld by the welding device movable along the joint gap. This means that two separate devices are no longer required for shaping and for retaining the slotted tube in the welding position. This also eliminates the laborious transfer of the slotted tube, with the necessary alignment and clamping.

In a first embodiment of the invention the sheet metal blank is first pushed by one half completely into one of the form gaps and then by its other half into the other form gap. One of the two form tool halves, more particularly the movable one, can have adjacent the entry to the form gap an abutment against which one longitudinal edge of the sheet metal blank can bear when the form tool halves are moved together. This gives the sheet metal blanks satisfactory guiding, making it impossible for the blank to be introduced at an angle into the form gap.

To improve the geometry of the joint gap, during or after its emergence from the form gap the sheet metal blank can be so after-shaped in narrow strips adjoining the longitudinal edges that they merge substantially tangentially into one another. With the apparatus this can be effected in two ways. Either a tool acting on the longitudinal edges in the sense of moving them together is associated with the top zone, or the form gaps terminate at the top in a common horizontal plane.

The required spatial fixation of the internal mandrel halves in the outer half shells with the possibility of being able to remove the shaped tube can, according to a further feature of the invention, be effected by the features that the outer half shell and the internal mandrel half of each form tool half are connected to one another at one of their ends, and the internal mandrel half is releasably located by its other end directly on the tool support, the internal mandrel half being otherwise retained in position by a number of supporting members which extend through the outer half shell via recesses and can be uncoupled via sliding couplings on the internal mandrel half in the direction of the outer half shell.

Constructionally this can be put into effect by the feature that the outer half shell and the internal mandrel half connected thereto at one end bear against one another without a gap in this connecting portion and are held together by releasable clamping elements. The result is a highly precise association between the half shell and the internal mandrel half with a very simple assembly. The releasable clamping elements enable the form gap to be somewhat opened, to pull the finished tube out of the form tool or even to pull the internal mandrel halves out of the finished tube.

To enable the tube to be pulled out of the form tool with the front end of the internal mandrel half released, without the internal mandrel half making it difficult to pull out the tube by bearing thereagainst, according to a feature of the invention the internal mandrel half projects in relation to the outer half shell at the connected end, and associated with the projecting portion is a pressure element via which a pivoting force around a horizontal transverse axis in the sense of relieving the front end of the internal mandrel half can be applied to the internal mandrel half.

To prevent the sheet metal blank from bending outwards when the blank is introduced into the form gaps, according to the invention a vertically adjustable supporting construction for the sheet metal blank to be introduced into the form gaps is provided immediately below and in the receiving position between the form tool halves. The supporting construction preferably has at the entrance of each form gap a deflecting plate extending over the entire length of the form gap and is borne resiliently in the direction in which the form tool halves move. The deflecting plates yield when on completion of shaping the form tool halves arrive in the closed position.

The precise positioning of the longitudinal edges at the top point of the form tool halves for straight bead welding can be ensured using simple means. According to one feature of the invention associated with one of the two form tool halves, more particularly the fixed one, is a retractable stop at the top for the longitudinal edge of the portion of the sheet metal blank shaped in said form tool half. The stop also then acts as a support when the sheet metal blank is inserted into the form gap of the other form tool half. Preferably the stop has a tip so asymmetrically constructed that when the other longitudinal edge impinges on said stop the stop yields, releasing one longitudinal edge, and both longitudinal edges impinge on one another, thus forming a butt joint.

To prevent dirt occurring during welding, such as splashes of melt or smoke (for example, evaporated zinc in the case of galvanized sheets) from dirtying the form tool, according to one feature of the invention an intercepting bowl is disposed in the zone of the top of the internal mandrel halves. Such an intercepting bowl can be cleaned or interchanged after each use of the welding device.

Preferably the intercepting bowl is disposedly fixed and extends over the entire length of the form tool halves. With such a construction also according to a possible feature of the invention the intercepting shell is connected tightly to the internal form halves and co-operates with the exposed longitudinal edge zones of the tube formed from the sheet metal blank to form a channel. Such a channel is suitable for protective gas flushing or for removing by suction the vapors occurring during welding.

Conveniently the intercepting bowl is made of a flexible material and has a V-shaped cross-section. This construction is particularly suitable, since it can readily adjoin the internal mandrel halves and does not impede the moving together of the form tool halves, since during this it folds together.

However, alternatively the intercepting bowl can be constructed to move together with the welding device. Constructionally this can readily be effected if according to the invention the intercepting bowl is borne at the end face by a tappet for the ejection of the internal mandrel halves.

BRIEF DESCRIPTION OF THE SEVERAL VIEWS OF THE DRAWINGS

An embodiment of the invention will now be explained in greater detail with reference to the drawings, which show.

DETAILED DESCRIPTION OF THE INVENTION

Figure 1:
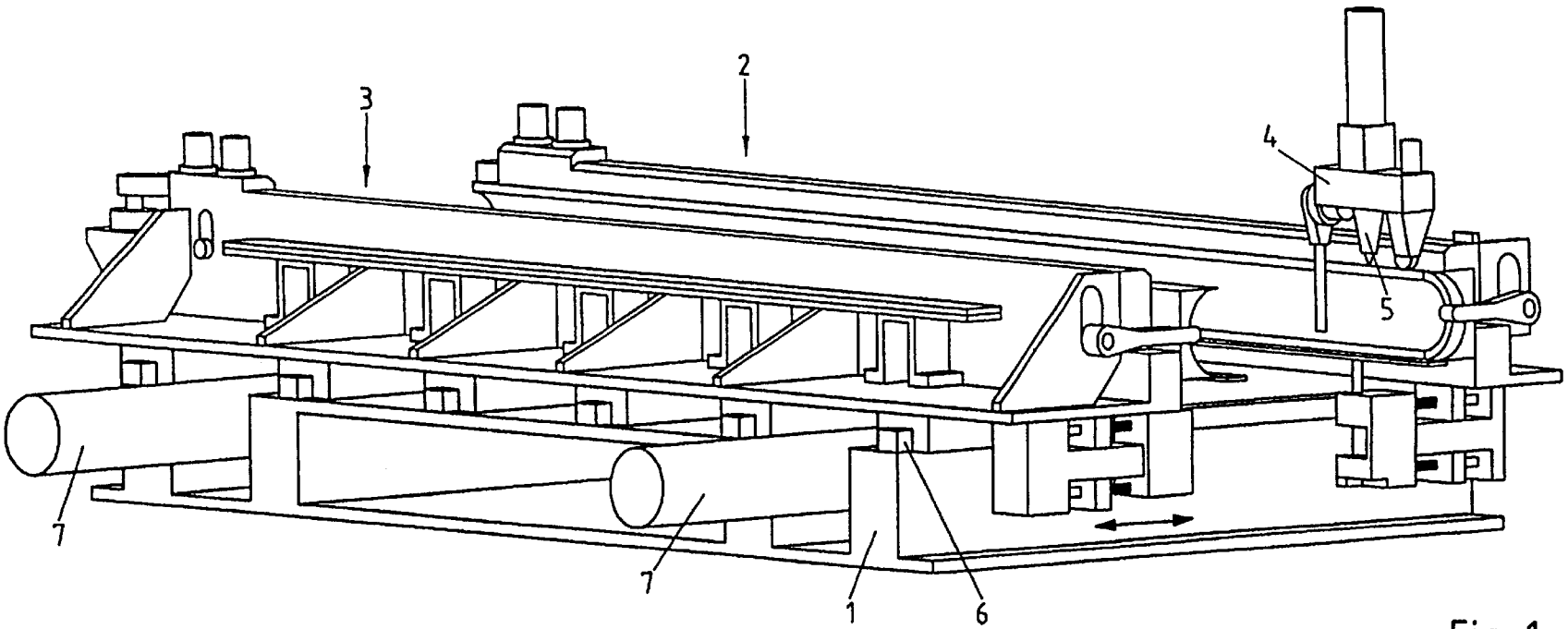
FIG. 1 a perspective view of an apparatus for the production of straight bead welded tubes from flat sheet metal blanks, FIG. 2 a perspective view to an enlarged scale of a detail of the apparatus shown in FIG. 1, viewed from the front side, FIG. 3 a front view of the apparatus shown in FIG. 1, FIG. 4 a perspective view to an enlarged scale of a detail of the apparatus shown in FIG. 1, viewed from the rear side, FIG. 5 a perspective view to an enlarged scale, and from a different perspective from FIG. 4, of a detail of the apparatus shown in FIG. 1, viewed from the rear side, FIG. 6 a simplified front view of two form tool halves of the apparatus shown in FIG. 1, and FIG. 7 a front view of one of the form tool halves shown in FIG. 6, with additional details.

Built up on a tool support 1 is a form tool consisting of two form tool halves 2, 3. A welding device 5 for straight bead welding can be driven by means of a carriage 4 over the form tool halves 2, 3. While the form tool half 2 is disposedly fixed on the tool support 1, the form tool half 3 is mounted on linear guides 6 and can be moved by means of adjusting cylinders 7 in the direction of the other form tool half 2.

Figure 2:
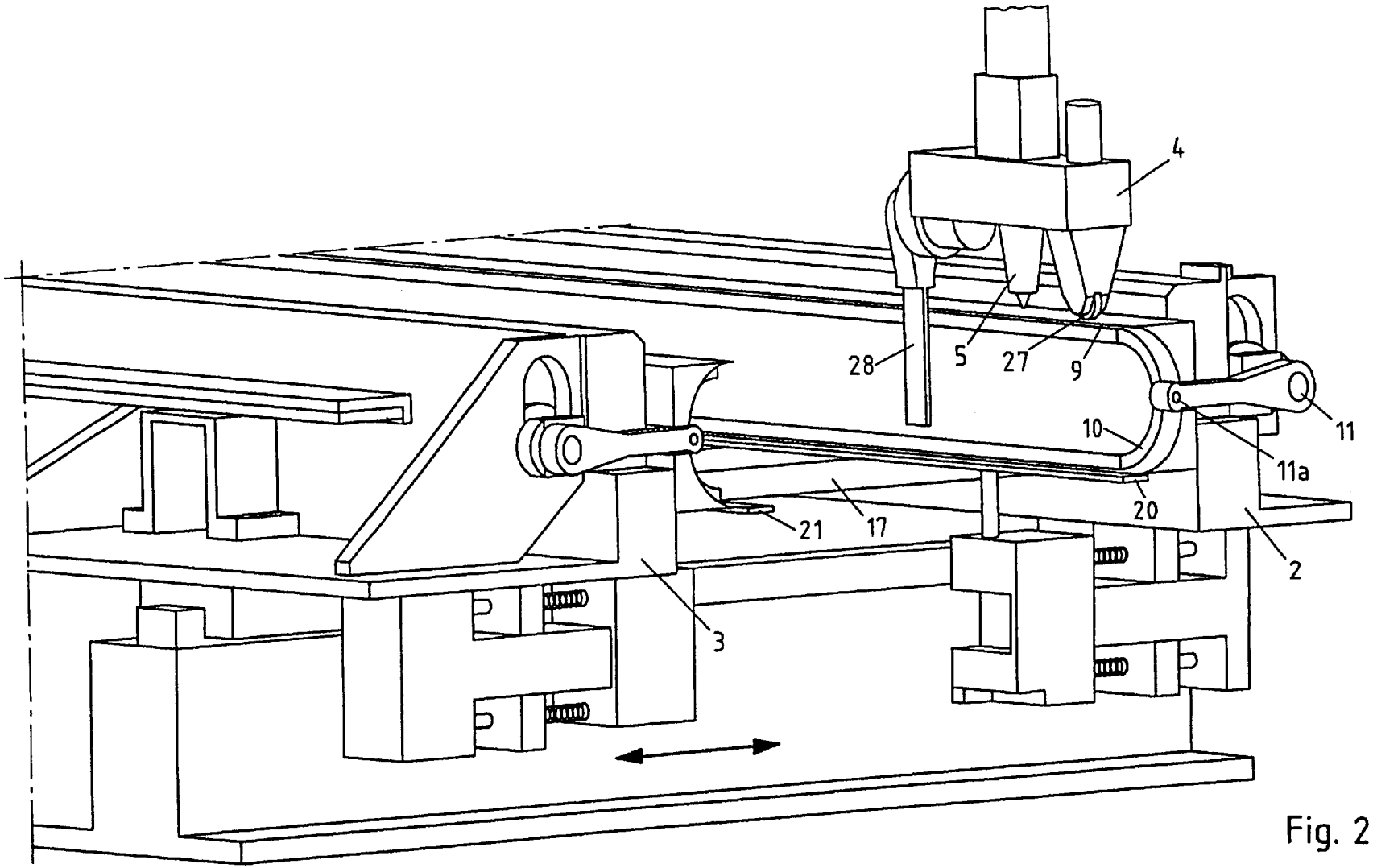
Figure 4:
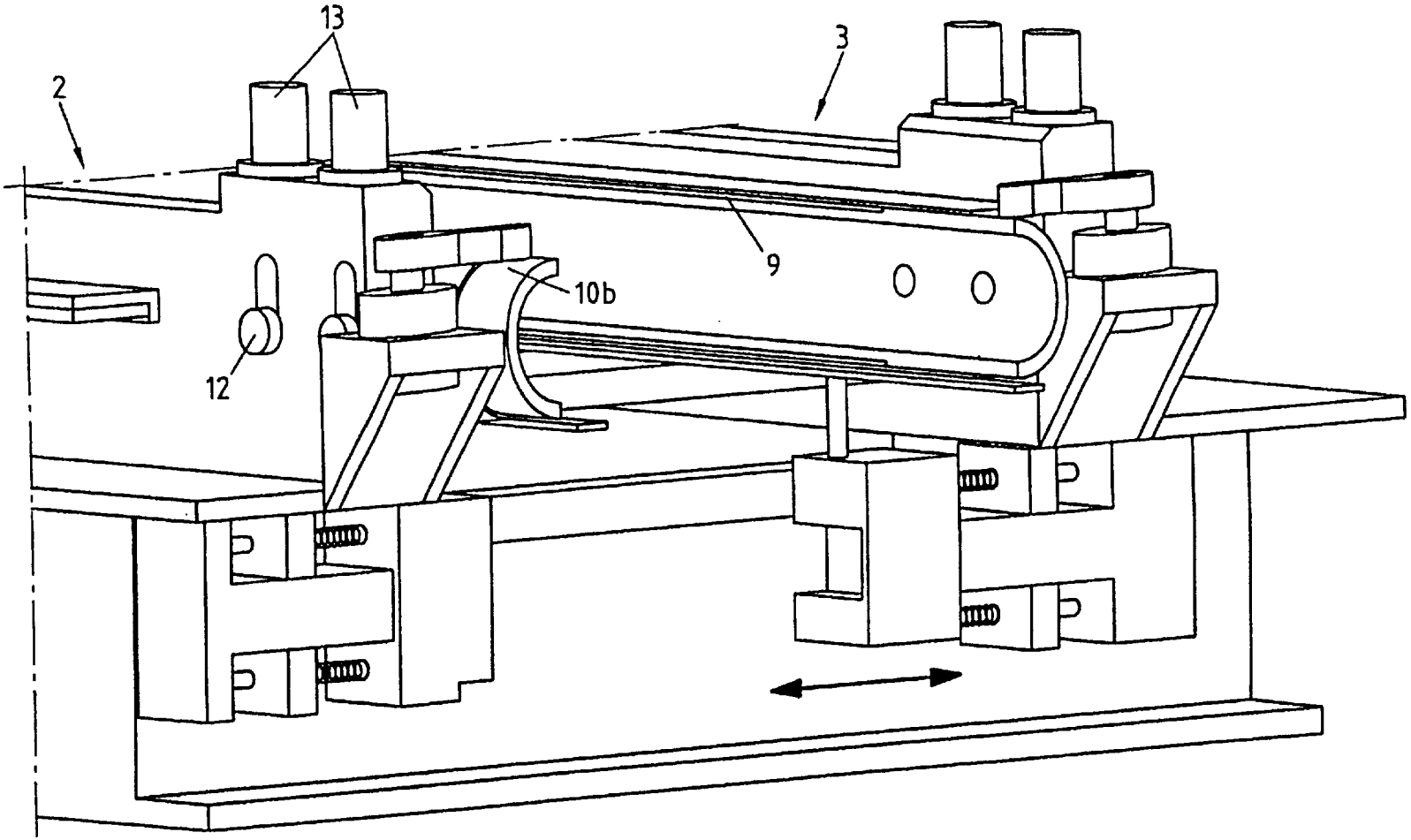
Figure 5:
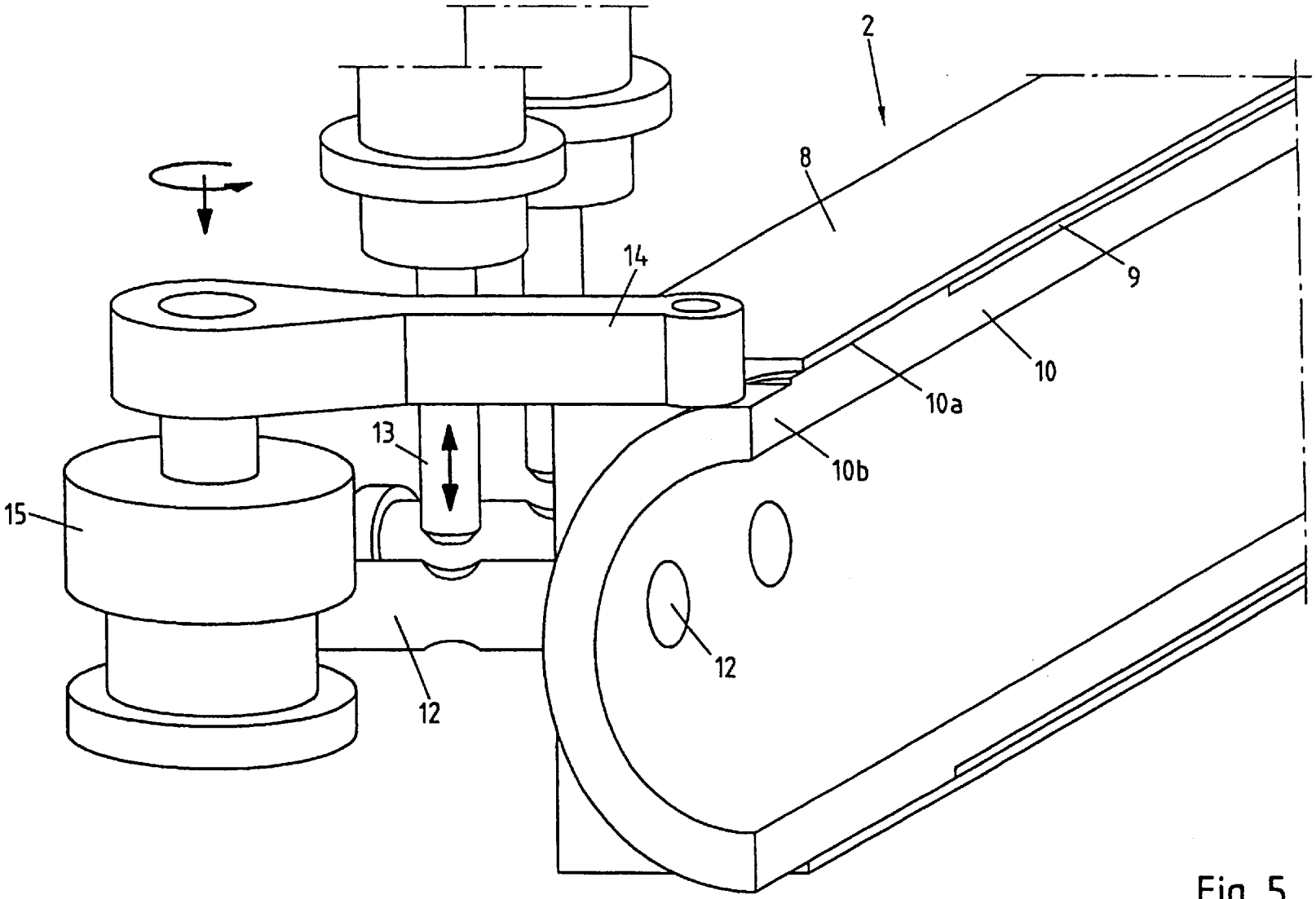

The form tool halves 2, 3 are of substantially identical construction. They consist of an outer cylindrical half shell 8 (see FIG. 6) which is made up of individual portions in the longitudinal direction, and an internal mandrel half 10 fixed therein with the formation of a form gap 9. At the front end (cf. FIG. 2) the internal mandrel half 10 is retained by means of a pivoting arm 11 engaging with an end face pin 11*a* of the internal mandrel half 10. The internal mandrel half 10 has at the rear end (cf. FIGS. 4, 5) a portion 10*a* of enlarged external diameter which is identical to the internal diameter of the half shell 8. Via the portion 10*a* the internal mandrel half 10 bears firmly against the half shell 8. The portion 10*a* projects by an amount 10*b* axially in relation to the half shell 8. Engaging with the portion 10*a* in this portion 10*b* are releasable pulling elements 12 which can be pulled radially outwards and therefore against the half shell 8 by means of couplable clamping pins 13. A pivoting force around a horizontal axis extending transversely of the longitudinal direction can be exerted on the projecting portion 10*b* by means of a pivoting arm 14 and an adjusting cylinder 15. Operation will be further discussed hereinafter in connection with the removal of a finished tube.

Figure 7:
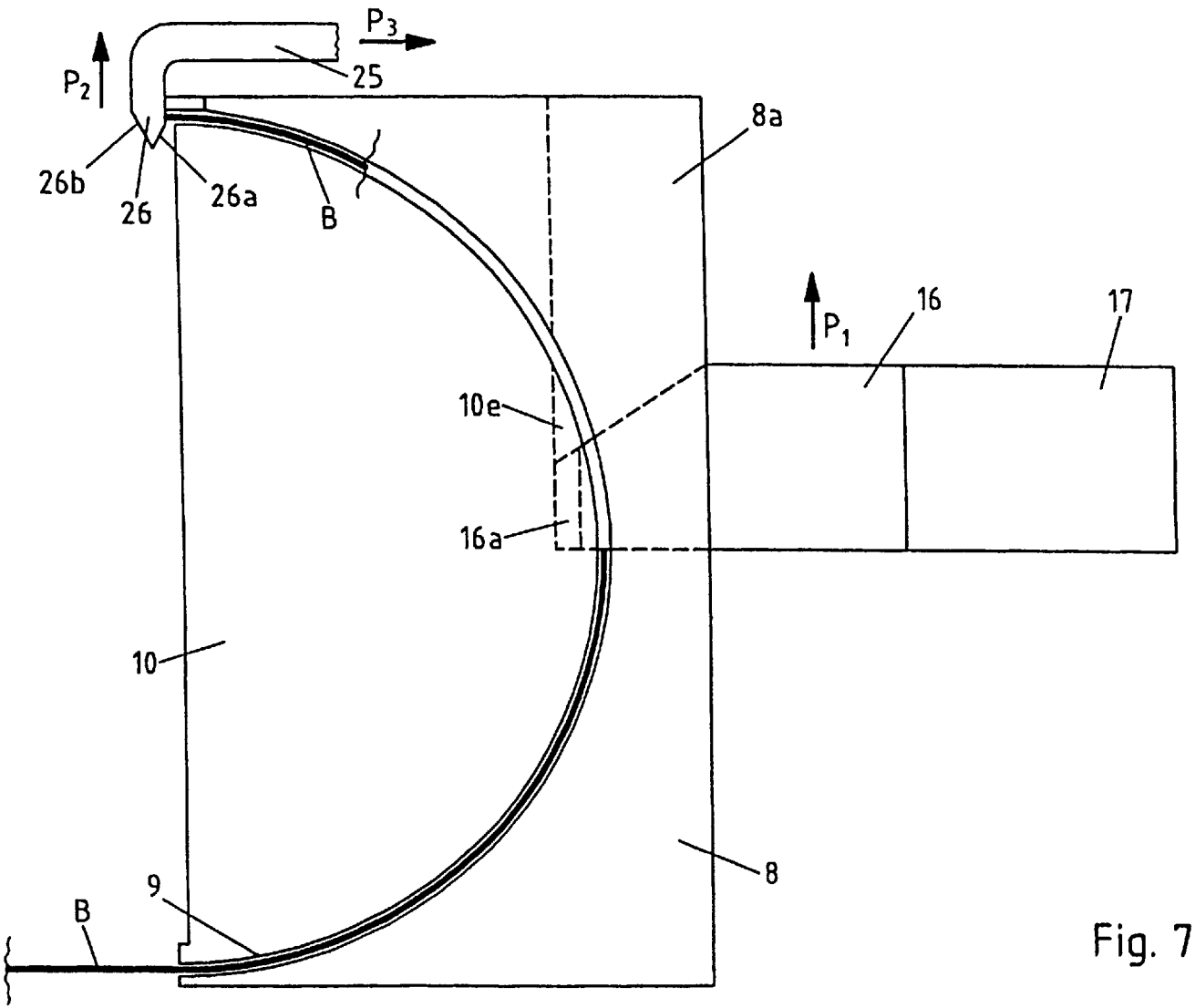

To enable the internal mandrel halves 10 to be supported in the radial direction in the zone between their ends, they are engaged by supporting members 16 (see FIG. 7) forming part of a comb 17. The supporting members 16 engage through recesses 8*a* in the form of slots in the half shell 8 and are coupled to the internal mandrel half 10 via sliding couplings consisting of a cylindrical attachment 16*a* and a corresponding recess 10*e* in the internal mandrel half 10. They can be uncoupled from the internal mandrel half 10 by displacement in the direction indicated by arrow P1. This is necessary to ensure that the supporting members 16 do not block the form gap 9 during the insertion of a sheet metal blank B. Alternatively, the fixation of the internal mandrel half 10 can also be effected by fixing mandrels which engage substantially radially through the half shell 8 and can be moved transversely of the form tool longitudinal axis and engage in recesses provided in the internal mandrel half. As a result, the internal mandrel half 10 is supported and fixed axially and radially. Preferably the fixing mandrels are adjusted at an angle of approximately 45° to the vertical plane of symmetry.

Provided below the two form tool halves 2, 3 and in the brought-up condition therebetween is a supporting construction 18 for the sheet metal blank to be shaped. The supporting construction 18 receives the sheet metal blank B and prevents it from bending downwards during introduction into the form gap 9. The supporting construction 18 consists of a number of parallel beams 19 disposedly fixed on the tool support 1 transversely over the longitudinal direction of the apparatus, and deflecting plates 20, 21 which are disposed at each form gap and are supported by resiliently borne guides 22, 23. When the form tool halves 2, 3 are moved together, the deflecting plates 20, 21 boost the introduction of the sheet metal blank B into the form gap 9, outward bending of the sheet metal blank B lying by its own weight on beams 19 being prevented thereby. Due to the resilient bearing of the deflecting plates, they yield at the end of this shaping process, so that the form tool halves 2, 3 can be moved completely together.

The internal mandrel half 10 (cf. FIGS. 6, 7) of one form tool half 3 has at the lower end a projection 24 and thereabove an abutment 24*a*. During its introduction into the form gap 9 of the other form tool half 2 one longitudinal edge of the sheet blank B is borne thereon and thereagainst.

Associated with the form tool half 2 at its top is a stop 25 which can move in the direction of the arrows P2, P3 in such a way that the sheet metal blank B inserted into the form gap 9 abuts by its longitudinal edge the vertical flank 26 of the stop 25—i.e., above a short chamfer 26*a*. An opposite cutting edge 26*b* is substantially longer and lies in the zone of emergence of the other form gap 9, so that the sheet metal blank emerging at this place impinges on the chamfer 26*a* by its longitudinal edge.

The half shell 8 and the internal mandrel half 10 can terminate at the top in horizontally extending portions 8*b*, 10*c*. This configuration serves to bring the longitudinal edges into an even better position for welding. However, alternatively the carriage 4 can also have a contact pressure roller 27 which precedes the welding device 5 and forces the longitudinal edges downwards.

Figure 6:
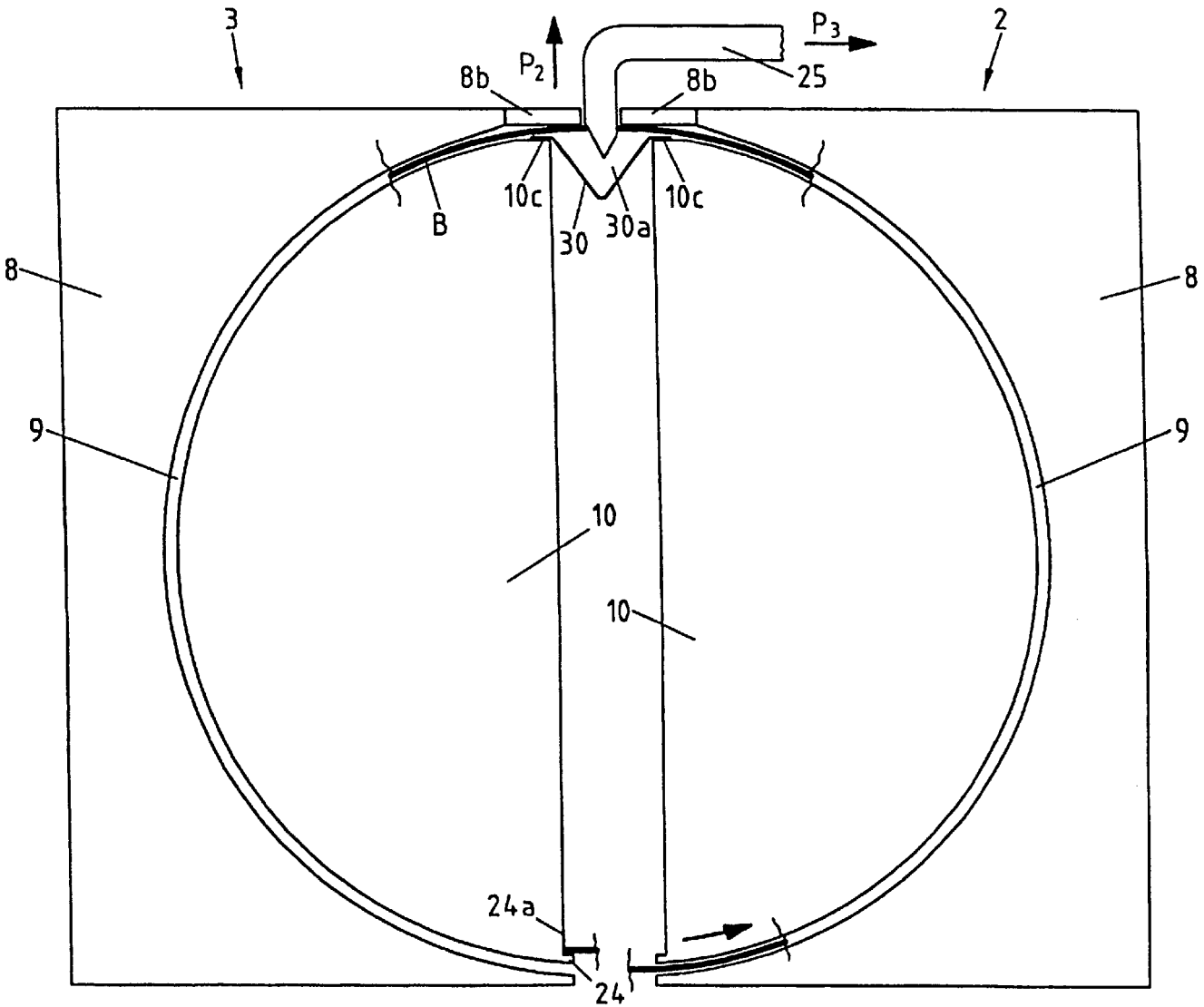

As shown in FIG. 6, disposed at the top point of the form tool halves 2, 3 is a fixed intercepting bowl 30 taking the form of a V-shaped profile with outwardly bent ends via which it bears against the portions 10*c*. The intercepting bowl 30 is flexible, being more particularly made of sheet metal, so that it can be folded together when the form tool halves 2, 3 are moved together. It extends over the entire length of the form tool halves 2, 3 and serves for collecting waste materials deposited during welding. It collaborates with the brought-together ends of the tube formed from the sheet metal blank B to form channel 30*a* for a protective gas flushing, or it can act as a sectional removal channel.

There is an alternative construction for the intercepting bowl (not shown). In the alternative construction a bowl is provided which travels together with the welding device 5. The bowl can be disposed at the end of a tappet by means of which the internal mandrels 10 can be ejected in accordance with the progress of the weld.

To shape sheet metal blanks of different thicknesses (tailored blanks), more particularly sheet metal blanks consisting of welded-together sheets of different thicknesses, the form gap has a different width, corresponding to the different thickness of the sheet, either in the peripheral or the longitudinal direction. In the case of sheet metal blanks with small differences in thickness up to approximately 0.1 mm, the form gap can have a constant width, since the small differences in thickness lie within the range of the overdimensioning of the form gap which must be provided in any case.

Figure 3:
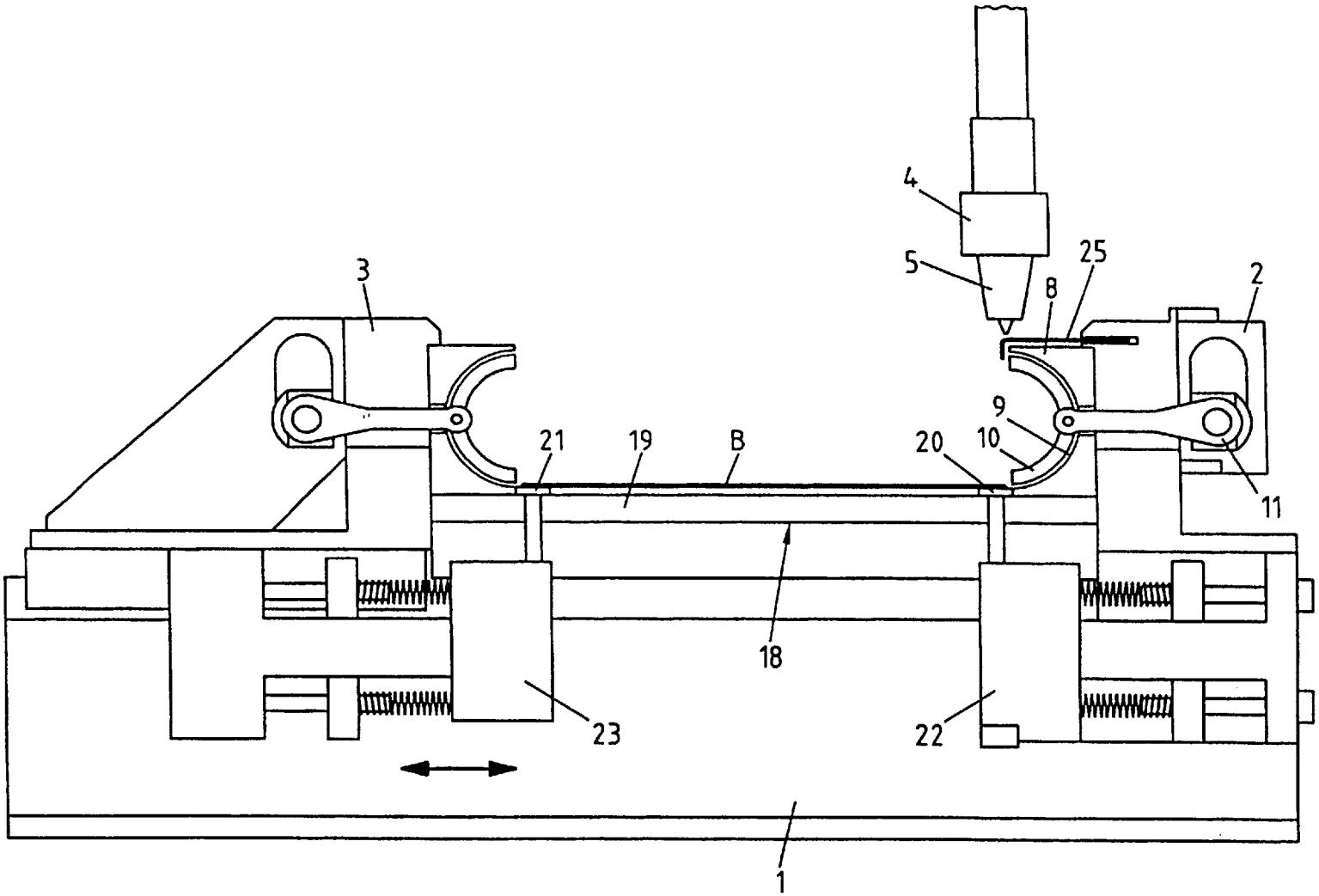

The apparatus according to the invention operates as follows:

As shown in FIG. 3, with the form tool halves 2, 3 moved up, a sheet metal blank B with parallel longitudinal edges is laid on the supporting construction 18. The sheet metal blank B is threaded by the longitudinal edge shown on the right in the drawing into the form gap 9 of the form tool half 2. The left-hand longitudinal edge is laid on the projection 24 of the internal mandrel half 10 of the other form tool half 3, so that the sheet metal blank B bears via said longitudinal edge against the abutment. The abutment 24*a* gives the sheet metal blank B precise guiding, so that the sheet metal blank B cannot tilt in the form gap 9. The form tool half 3 is then driven in the direction of the form tool half 2. The sheet metal blank B is inserted into the form gap 9 until its right-hand longitudinal edge is situated adjacent the supporting members 16. Then the supporting members 16 are pulled over the sliding couplings, so that the form gap 9 is completely opened up. Then the sheet metal blank B is further advanced, until the longitudinal edge abuts the stop 25, namely at a vertical flank, as shown clearly in FIGS. 6 and 7. Since, there is no force operating in the direction of arrow P2, the stop 25 remains in the position shown.

Then the form tool half 3 is retracted a little until the left-hand longitudinal edge no longer bears against the projection 24. The sheet metal blank B is then threaded by its left hand longitudinal edge into the form gap 9 of the form tool half 3, and the form tool half 3 is driven in the direction of the form tool half 2. The supporting members of the internal mandrel half are removed in the same manner as in the case of the right-hand internal mandrel half. As soon as the sheet metal blank with its left hand longitudinal edge leaves the form gap 9 and impinges on the stop 25, namely on the chamfer 26*b*, the stop 25 is moved upwards by the longitudinal edge in the direction of arrow P2. With this movement the right-hand longitudinal edge also arrives on the chamfer 26*a* and is released, so that with further pushing-together the longitudinal edges impinge on one another in precisely the required welding position. Then the stop 25 is removed from the zone of the top by means which are not shown and the joint gap for the straight bead welding is opened up. If necessary, the sheet metal edges can be after-shaped by contact pressure means prior to welding, to compensate for the springing up of the sheet metal edges due to the elasticity of the material and to obtain a parallel joint gap.

However, before moving together takes place, the intercepting bowl 30 taking the form of a V-shaped profile is laid by its outwardly pointing angled edges on the horizontal zones 10*c* and thus supported by the internal mandrel halves 10. After further movement together, the intercepting bowl 30 becomes further folded and co-operates with the freely projecting edge zones of the tube formed from the sheet metal blank B to form a channel through which protective gas can be conveyed or via which vapour can be guided.

There are two possible ways of removing the straight bead welded tube from the apparatus. However, in any case the first thing is that the pivoting arms 11 at the front end are released. The tensioning at the rear end is then also released by pulling the pins 13 upwards. Then the form tool half 3 is moved back a little. In the first alternative, after the pulling members 12 have been removed the internal mandrel halves 10 can be pulled out. This is possible since they have clearance between them in the radial direction in the horizontal plane. In the second alternative the internal mandrel halves 10 remain in situ. However, to prevent the front end of the internal mandrel halves 10 from bearing against the tube and impeding its withdrawal, it can be somewhat lifted at the front end by a pivoting force being exerted on the projecting portion 10*b* by means of the pivoting arm 14 and the adjusting cylinder 15. In both cases the tube can then be pushed out of the half shells 8 by means of an entraining member 28 borne by the carriage 4.

The special advantages of the invention are that, using a comparatively simply constructed apparatus, it enables sheet metal blanks to be shaped into short tubes and to be straight welded in the clamping system provided for the sheet metal blanks by the form tool halves.

What is claimed is:

1. A process to produce a straight bead welded tube from a flat sheet metal blank having an inside and an outside, wherein the outside is constituted by parallel longitudinal edges, comprising:

shaping the flat sheet metal blank into a slotted tube by means of a first and a second of two tool halves constituting a form tool, each of the two tool halves having an outer cylindrical half shell and an internal cylindrical mandrel half fixed to the outer cylindrical half shell to produce a first and a second form gap, each of said two tool halves being disposed laterally inverted in relation to one another, wherein the first of the two tool halves moves toward the second of the two tool halves; and welding the longitudinal edges of the flat sheet metal blank to one another, wherein said longitudinal edges emerge exposed at a top of the form tool, to produce the straight bead welded tube at the top of the form tool, wherein during shaping the longitudinal edges are retained in position by the two form tool halves while the inside of the sheet metal blank is held by the internal cylindrical mandrel halves cooperating with the outer cylindrical half shells to produce the first and the second form gap.

2. A method according to claim 1, wherein the sheet metal blank is first pushed by one half completely into the first form gap and then by its other half into the second form gap.

3. A process according to claim 1, wherein during or after its emergence from the second form gap, the sheet metal blank is after-shaped in narrow strips adjoining the longitudinal edges so that the narrow strips adjoining merge substantially tangentially into one another.

4. An apparatus to produce straight bead welded tubes from flat sheet metal blanks with two parallel longitudinal edges comprising:

two form tool halves, a movable one and a fixed one, each of said two form tool halves having an outer cylindrical half shell borne by a tool support and an internal cylindrical mandrel half fixed to the outer cylindrical half shell to produce a first and a second form gap, wherein the two form tool halves are disposed laterally inverted in relation to one another, and are moved towards one another and out of an opened receiving position for the sheet metal blanks into a closed position, in which the two longitudinal edges to be welded to one another are held together by the two form tool halves into the closed position at a top point;

a welding device, which moves over the two form tool halves along the two longitudinal edges retained in a welding position, wherein the two form tool halves have cylindrical internal mandrel halves which are fixedly associated with the outer cylindrical half shells and which cooperate with the outer cylindrical half shells to produce form gaps for inseton of the sheet metal blanks, wherein the form gaps in the closed position of the two form tools halves retain the two longitudinal edges emerging therefrom at the top point exposed for welding.

5. An apparatus according to claim 4, wherein one of the two form tool halves has an abutment adjacent an entry to one of the form gaps against which one of the two longitudinal edges of a sheet metal blank is borne when the two form tool halves are moved together.

6. An apparatus according to claim 5, wherein the abutment is on the movable form tool half.

7. An apparatus according to claim 4, wherein a moving means is associated with the top point to move together the two longitudinal edges.

8. An apparatus according to claim 4, wherein the form gaps terminate at the top point in a common horizontal plane.

9. An apparatus according to claim 4, wherein an outer cylindrical half shell and an internal mandrel half of each of the two form tool halves are connected to one another at one of their ends, and wherein the internal mandrel half is releasably located by its other end directly on the tool support, the internal mandrel half being otherwise retained in position by a number of supporting members which extend through the outer cylindrical half shell via recesses and are uncoupled via sliding couplings on the internal mandrel half movable in the direction of the outer cylindrical half shell.

10. An apparatus according to claim 9 wherein the supporting members form a comb.

11. An apparatus according to claim 9, wherein the outer cylindrical half shell and the internal mandrel half connected thereto at one end bear against one another without a gap in a connective portion and are held together by releasable clamping elements.

12. An apparatus according to claim 11, wherein the internal mandrel half projects in relation to the outer cylindrical half shell at the connective portion and defines a projecting portion, said internal mandrel half comprising a pressure element associated with the projecting portion in which a pivoting force is applied around a horizontal transverse axis to relieve a front end of the internal mandrel half.

13. An apparatus according to claim 4, wherein a vertically adjustable supporting construction blank is provided for the sheet metal to be introduced through an entrance into the form gaps immediately below and in the opened receiving position between the two form tool halves.

14. An apparatus according to claim 13, wherein the supporting construction blank has a deflecting plate extending over the entire length of each of the form gaps at the entrance of each of said form gaps and wherein said deflecting plate is borne resiliently in a direction in which the two form tool halves move.

15. An apparatus according to claim 4, wherein a retractable stop is associated with one of the two form tool halves at the top portion of the sheet metal blank shaped in said one of the two form tool halves.

16. An apparatus according to claim 15, wherein the retractable stop is associated with the fixed form tool half.

17. An apparatus according to claim 15, wherein the retractable stop has an asymmetric tip so that when one of the two longitudinal edges impinges on said retractable stop, the stop yields, releasing one of the two longitudinal edges, and the two longitudinal edges impinge on one another.

18. An apparatus according to claim 4, further comprising an intercepting bowl for collecting waste materials during welding, said intercepting bowl being disposed in a top zone of the cylindrical internal mandrel halves.

19. An apparatus according to claim 18, wherein the intercepting bowl is fixedly disposed and extends over the entire length of the two form tool halves.

20. An apparatus according to claim 19, wherein an intercepting shell is connected tightly to the cylindrical internal mandrel halves and cooperates with exposed zones of the two longitudinal edges of the tube formed from the sheet metal blanks to make a channel.

21. An apparatus according to claim 19, wherein the intercepting bowl is made of a flexible material and has a V-shaped cross-section.

22. An apparatus according to claim 18, wherein the intercepting bowl is constructed to move together with the welding device.

23. An apparatus according to claim 22, wherein the intercepting bowl is borne at an end face by a tappet for ejection of the cylindrical internal mandrel halves.

* * * * *